US005713315A

United States Patent [19]

Jyoutaki et al.

[11] Patent Number: 5,713,315

[45] Date of Patent: Feb. 3, 1998

[54] MULTIPLE STEP VALVE OPENING CONTROL SYSTEM

[75] Inventors: Hiroshi Jyoutaki; Kazutoshi Mori, both of Kanagawa; Susumu Kohketsu; Yasunori Daigo, both of Tokyo, all of Japan; Yoshihisa Yamaki, Amstelveen, Netherlands

[73] Assignee: Mitsubishi Jidosha Kogyo Kabushiki Kaisha, Tokyo, Japan

[21] Appl. No.: 671,638

[22] Filed: Jun. 28, 1996

[30] Foreign Application Priority Data

Jun. 30, 1995 [JP] Japan ..... 7-198929

[51] Int. Cl.[6] ..... F01L 9/02; F02M 25/07

[52] U.S. Cl. ..... 123/90.12; 123/90.14; 123/568; 123/571; 251/31; 251/285

[58] Field of Search ..... 123/90.12, 90.13, 123/90.14, 90.15, 568, 569, 571; 251/31, 63.6, 285

[56] References Cited

U.S. PATENT DOCUMENTS

| | | | |
|---|---|---|---|
| 4,817,375 | 4/1989 | Brocard et al. | 251/285 |
| 4,915,015 | 4/1990 | Richeson et al. | 123/90.14 |
| 4,930,464 | 6/1990 | Letsche | 123/90.12 |
| 4,961,413 | 10/1990 | Grey et al. | 123/568 |
| 5,193,495 | 3/1993 | Wood, III | 123/90.14 |
| 5,603,305 | 2/1997 | Miyake et al. | 123/568 |

FOREIGN PATENT DOCUMENTS

| | | |
|---|---|---|
| 1321539 | 2/1963 | France . |
| 1361178 | 6/1963 | France . |
| 547401 | 6/1993 | Japan . |

OTHER PUBLICATIONS

Patent Abstracts of Japan, vol. 17, No. 31 (M-1356), JP4252851, Sep. 1992.

*Primary Examiner*—Weilun Lo

[57] ABSTRACT

A multiple step valve opening control system, particularly for an EGR control valve unit, having a plurality of valve lifts. The system comprises a valve member for opening a fluid passage in multiple steps, a first piston slidably housed in a housing, a second cylinder substantially coaxial with the first piston, a second piston fitted in the second cylinder and coupled to the valve member, and a first piston stroke regulating member which is moved selectively to a first position for regulating an allowable displacement of the first piston to a first predetermined extent ($l_1$) or to a second position for regulating the allowable displacement of the first piston to the first predetermined first extent ($l_1$) plus a third predetermined extent ($l_3$). By changing the position of the first piston displacement regulating member, the valve member is opened by various valve lifts.

18 Claims, 7 Drawing Sheets

MULTIPLE STEP VALVE OPENING CONTROL SYSTEM

BACKGROUND OF THE INVENTION

1. Field of the Invention

This invention relates to valve system for controlling valve opening in multiple steps, and more particularly to a multiple step valve opening control system for enabling an EGR control valve in a diesel engine of a vehicle to open in multiple steps.

2. Description of the Prior Art

As is well-known, some of the exhaust gases from a vehicle engine are recirculated via an EGR control valve to an engine intake system in order to reduce $NO_x$ in the exhaust gases. For this purpose, a diaphragm type actuator which is responsive to a fluid pressure is extensively used to control opening of the EGR control valve, thereby regulating the amount of recirculated exhaust gasses in accordance with engine operating conditions.

However, such a diaphragm type actuator controls the opening of the EGR control valve by regulating the fluid pressure (usually compressed air pressure or negative pressure) acting on a diaphragm, so that it is difficult to reliably control the valve opening over a long period of time. Further, the actuator should be operated under feedback control. This not only complicates the structure of the EGR control valve but also causes the valve opening to easily vary if there are any slight disturbances.

Japanese Utility Model Laid-Open Publication No. Hei 5-047,401 shows and discloses a multiple step EGR control valve unit in order to overcome the foregoing problems of the EGR control valve including the diaphragm type actuator. This EGR control valve unit can reliably control its opening without precise adjustment of the pressure of a working fluid and complicated feedback control.

FIG. 11 of the accompanying drawings shows the configuration of the foregoing EGR control valve unit. As shown, the EGR control valve unit 01 includes a housing 02 which is interposed in an EGR passage (not shown), and extracts and recirculates some of the exhaust gases to an engine intake system. The housing 02 encloses a valve member 04 and an actuator 05. The valve member (poppet valve) 04 is disposed in an exhaust gas passage 03, and controls a flow amount of exhaust gases. The actuator 05 is operably coupled to a valve stem 04', and controls the opening or lift of the valve member 04.

The actuator 05 includes a cylinder 06, a first piston 07, and a second piston 08. The cylinder 06 is structured so as to be substantially coaxial with the valve stem 04'in the housing 02. The first piston 07 is slidably fitted in the cylinder 06, while the second piston 08 is slidably fitted in the first piston 07, and is coupled to the upper end of the valve stem 04.

The first piston 07 has a hollow cylindrical member 07*a* fitted in the cylinder 06 , and a piston member 07*b* which is fixed, using a snap ring 09, to an open end of the hollow cylindrical member 07*a*. The open end is positioned far away from the valve member 04. A projection or stop 010 is present at an open end of the cylindrical member 07*a*, near the valve member 04, and extends from an inner wall of the cylindrical member 07*a* toward the center of the cylindrical member 07*a*. The second piston 08 is slidable in the cylindrical member 07*a*.

The housing 02 includes a first intake/exhaust port 011 at its end opposite to the valve member 04. The intake/exhaust port 011 is connected to a working medium source such as a compressed air source via a three-way solenoid valve (not shown), and continuously communicates with a first working chamber 012 defined by the first piston 07 in the cylinder 06. A second intake/exhaust port 013 is on a side wall of the housing 02, and continuously communicates with a second working chamber 014 defined by the first and second pistons 07 and 08 in the cylinder 06. A valve spring 015 is disposed, in a compressed state, between the second piston 08 and the side wall of the cylinder 06 near the valve member 04, and continuously urges the valve member 04 to remain closed.

FIG. 11 shows a state in which the first and second intake/exhaust ports 011 and 013 do not receive any compressed air but communicate with the atmosphere. In this state, the valve member 04 is completely closed, and a clearance $L_1$ is present between the stop 010 of the first piston 07 and a shoulder 016 of the cylinder 06. The clearance $L_1$ defines a first valve lift of the valve member 04 toward the valve stem 04'. Further, the second piston 08 is pushed by the valve spring 015, and comes into contact with a projection or a push rod 017 which is integral with the first piston 07. Thus, there is a clearance $L_2$ between the second piston 08 and the stop 010, defining a second valve lift of the valve member 04 toward the valve stem 04'.

When compressed air is introduced into the second working chamber 012 via the first intake/exhaust port 011, the first piston 07 compresses the valve spring 015 via the second piston 08, so that the end of the stop 010 near the valve member 04 is displaced to come into contact with the shoulder 016 of the cylinder 06. Thus, the valve member 04 is opened by a first valve lift or opening corresponding to the clearance $L_1$ (called "the first valve lift or opening $L_1$), so that an amount of exhaust gases corresponding to the first valve lift $L_1$ will flow through the exhaust gas passage 03 and be recirculated to the intake system of the engine.

When the compressed air is introduced into a second working chamber 014 from the second intake/exhaust port 013 (while the first intake/exhaust port 011 remains open to the atmosphere), the second piston 08 independently compresses the valve spring 015 and displaces itself until it comes into contact with the stop 010. In this state, the valve member 04 is opened by a second valve lift corresponding to the clearance $L_2$ (called "the second valve lift or opening $L_2$), thereby recirculating exhaust gases to the intake system of the engine in accordance with the valve lift or opening $L_2$.

Further, when the compressed air is introduced into both the first and second intake/exhaust ports 011 and 013, both the first and second pistons 07 and 08 are displaced toward the valve stem 04' in accordance with the first and second valve lifts or openings $L_1$ and $L_2$. Therefore, the valve member 04 is opened by a valve lift or opening $L_3$ ($=L_1+L_2$).

It is assumed here that a minimum valve lift or opening of the valve member 04 is 1 mm and a maximum valve lift is 10 mm, for example, in accordance with operating conditions of the engine. In the prior art shown in FIG. 11, the minimum valve lift $L_2$ is 1 mm, and the maximum valve lift $L_3$ is 10 mm, so that the intermediate valve lift $L_1$ is 9 mm. Therefore, in the cited reference, there are three valve lifts, $L_1$=9 mm, $L_2$=1 mm, and $L_3$=10 mm. In other words, there are one small valve lift, and two large valve lifts.

If the minimum valve lift or opening $L_2$ should be 1 mm and the intermediate valve lift or opening $L_1$ should be 2 mm, which is slightly larger than the minimum valve lift $L_2$ in accordance with the engine operating conditions, the maximum valve lift $L_3$ would be 3 mm ($=L_1+L_2$). In this case, the maximum valve lift or opening is not sufficient.

Thus, it is impossible to set the three valve lifts or openings in a wide range for the EGR control unit to assure reliable engine performance, especially efficient reduction of $NO_x$ from exhaust gases. This means that the engine would fail to operate with its optimum performance.

SUMMARY OF THE INVENTION

It is therefore a first object of the invention to provide a multiple step valve opening control system which can overcome the problems of the foregoing multiple step valve, particularly an EGR valve control unit, and set three valve lifts or openings in a wide range, especially by maintaining a sufficient maximum valve lift or opening and reliably assuring two smaller valve lifts or openings.

A further object of the invention is to provide a multiple step valve opening control system which is applicable to an EGR valve control unit in a vehicle engine such as a diesel engine for a truck or the like, assures good engine performance such as sufficient output and fuel consumption, and effectively reduces $NO_x$ in exhaust gases.

According to a first aspect of the invention, there is provided a multiple step valve opening control system comprising: a valve member interposed in a fluid passage, the valve member being opened by a plurality of steps for controlling a flow amount of a fluid; a first piston slidably fitted in a first cylinder disposed in a housing a second cylinder substantially coaxially coupled to or being integral with the first piston; a second piston slidably fitted in the second cylinder and operatively coupled to the valve member; a resilient member coupled to the valve member, the resilient member continuously urging the valve member in a closing direction; a first intake/exhaust port formed in the housing, the first intake/exhaust port supplying a working medium to a first working chamber defined in the first cylinder, and displacing the first piston via the second piston in a direction for opening the valve member; a second intake/exhaust port formed in the housing, the second intake/exhaust port supplying the working medium to a second working chamber defined in the second cylinder, and displacing the second piston by a second predetermined extent in the direction for opening the valve member; and a first piston stroke regulating member housed in the housing, the first piston stroke regulating member being held at a first position for regulating, to a first predetermined extent, an allowable displacement of the first piston in the opening direction of the valve member when the working medium is supplied to the second working chamber from the second intake/exhaust port, and the first piston displacement regulating member being held at a second position for regulating the allowable displacement of the first piston in the opening direction of the valve member to the first predetermined extent with the addition of a third predetermined extent, when no working medium is supplied to the second working chamber from the second intake/exhaust port but the working medium is supplied to the first working chamber from the first intake/exhaust port.

In this arrangement, the first piston stroke regulating member includes a third piston which is fitted in a third cylinder in the housing and is slidable between the first position and the second position, on an outer surface of the second cylinder.

It is preferable that the second intake/exhaust port communicates with the third working chamber in the third cylinder, and the second working chamber.

The maximum, minimum and intermediate valve lifts or openings can be independently set in a wide range. It is possible to accomplish the set valve lifts or openings precisely and quickly. The multiple step valve opening control system of the invention is industrially advantageous when it is applied to an EGR control valve of a diesel engine of a vehicle. When the second piston is fitted in the second cylinder integral with the first piston and the third piston is positioned around the second cylinder, the overall system can be made compact. Alternatively, when the operation of the second and the third pistons is controlled by a working medium supplied via the same intake/exhaust port, it is possible to simplify the working medium supplying circuit having a control valve coupled to the intake/exhaust port.

When the working medium is supplied to the third working chamber, the third piston is preferably held at the first position. Further, when the working medium is supplied to the third working chamber and the first working chamber, the first piston slides in the first cylinder in the opening direction of the valve member, and comes into contact with and is stopped by the third piston held at the first position, so that the displacement of the first piston is preferably regulated to the first predetermined extent.

Further, when no working medium is supplied to the third working chamber, the third piston is movable to the second position which is beyond the first position in the opening direction of the valve member. When no working medium is supplied to the third working chamber but the working medium is supplied to the first working chamber, the first piston slides in the first cylinder to the second position in the opening direction of the valve member, and comes into contact with and is held by the third piston, so that the displacement of the first piston in the opening direction of the valve member is preferably regulated to the sum of the first predetermined extent and the third predetermined extent.

The multiple step valve opening control system may further comprise a third piston urging member for urging the third piston in a closing direction of the valve member. In this case, when no working medium is supplied to the third working chamber but the working medium is supplied to the first working chamber, the first piston slides in the first cylinder in the opening direction of the valve member, comes into contact with the third piston at the first position, slides with the third piston to the second position against an urging force of the third piston urging member, and is held at the second position, so that the displacement of the first piston in the opening direction of the valve member is preferably regulated to the sum of the first and third predetermined extents.

The valve lifts of the valve member can be determined in a wide range between a relatively small valve lift and a relatively large valve lift when the valve member is opened in multiple steps with the third piston held at the first or second position. The whole system can have a simple structure, and is advantageously applied to the EGR control valve unit.

The multiple step valve lift control system may further comprise a stopper which is positioned near an end of the second cylinder in the opening direction of the valve member, is axially screwed into the second cylinder, and regulates the displacement of the second piston when the second piston slides in the second cylinder in the opening direction of the valve member and comes into contact with the stopper. The displacement of the second piston is adjustable by changing the position where the stopper is screwed into the second cylinder.

The displacement of the second piston is adjustable by changing the position where the stopper is screwed into the second cylinder. This makes the system applicable to a variety of devices, enhances fine adjustments, and facilitates countermeasures against aging.

The fluid passage is an EGR (exhaust gas recirculation) passage for recirculating extracted exhaust gases to an intake system of the engine. The valve member is an EGR control valve for controlling the flow amount of exhaust gases when it is applied to the intake system.

When it is applied to the EGR control valve, the system can control an amount of recirculated exhaust gases in multiple steps.

The system may be configured as follows, when it is applied to an EGR control valve unit. When the engine is operated in a first operating state where an engine speed is a predetermined speed or less and under a first predetermined load or less, the working medium is supplied to the first intake/exhaust port and the first piston is displaced by the third predetermined extent in the opening direction of opening the valve member. When the engine is operated in a second operating state where the engine speed is above the predetermined speed and under a second predetermined load or less, the working medium is supplied to both the first intake/exhaust port and the second intake/exhaust port, the first piston is displaced by the first predetermined extent in the opening direction of the valve member, and the second piston is displaced by the second predetermined extent in the opening direction of the valve member. Further, when the engine is operated in a third operating state which consists of an operating state where the engine speed is the predetermined speed or less and under a load above the first predetermined load, and an operating state where the engine speed is above the predetermined speed and a predetermined high speed or less which is higher than the predetermined speed and under a load above the second predetermined load, the working medium is supplied to the second intake/exhaust port, and the second piston is displaced by the second predetermined extent in the opening direction of the valve member.

The following function may be added. The valve member is made to remain closed by the resilient member, when the engine is operated in operating states other than the first to the third operating states, when the engine is abruptly accelerated, and when a temperature of engine cooling water is a predetermined value or less.

When the operation of the EGR control valve is controlled in multiple steps in accordance with engine operating conditions, the amount of recirculated exhaust gases can be appropriately controlled. Thus, the engine can improve its performance related to exhaust gases. Especially, no EGR is conducted while the engine is not sufficiently warmed up or it is abruptly accelerated, thereby improving the exhaust gas purifying performance.

The working medium supplied to the fist intake/exhaust port and the second intake/exhaust port is a compressed fluid, and the first intake/exhaust port and the second intake/exhaust port are preferably connected to a compressed fluid source via a first fluid control valve and a second fluid control valve, respectively.

This arrangement enables pressured fluid, such as pressured oil or compressed air for a brake system of an ordinary vehicle, to be used as the working medium. It is not necessary to prepare a dedicated source of the working medium.

The multiple step valve opening control system may further comprise a fourth working chamber formed in the housing at a first pressure receiving face opposite to a second pressure receiving face of the second piston which confronts with the second working chamber, and a third intake/exhaust port for supplying the working medium to the fourth working chamber.

The working medium supplied to the fourth working chamber enables to second piston to positively operate the valve member. This improves the response of the system, and exhaust gas purifying performance of the vehicle.

When the third intake/exhaust port is provided, it is preferable that the fluid passage is an EGR (exhaust gas recirculation) passage for recirculating a part of exhaust gases to an intake system of the engine, and the valve member is an EGR control valve for controlling a flow amount of exhaust gases recirculated to the intake system.

When it is applied to the EGR control valve, the system can responsively control the amount of recirculated exhaust gases in multiple steps.

The multiple step valve opening control system including the third intake/exhaust port can function as follows. When the engine is operated in a first operating state where an engine speed is a predetermined speed or less and under a first predetermined load or less, the working medium is supplied to the first intake/exhaust port and the first piston is displaced by the third predetermined extent in the opening direction of the valve member. When the engine is operated in a second operating state where the engine speed is above the predetermined speed and under a second predetermined load or less, the working medium is supplied to both the first intake/exhaust port and the second intake/exhaust port, the first piston is displaced by the first predetermined extent in the opening direction of the valve member, and the second piston is displaced by the second predetermined extent in the opening direction of the valve member. Further, when the engine is operated in a third operating state which consists of an operating state where the engine speed is the predetermined speed or less and under a load above the first predetermined load, and an operating state where the engine speed is above the predetermined speed and a predetermined high speed or less which is higher than the predetermined speed and under a load above the second predetermined load, the working medium is supplied to the second intake/exhaust port, and the second piston is displaced by the second predetermined extent in the opening direction of the valve member.

The multiple step valve opening control system may include an additional function, in which the valve member is made to remain closed by the resilient member when the engine is operated in operating states other than the first to the third operating states, when the engine is abruptly accelerated, and when a temperature of engine cooling water is a predetermined value or less.

When the operation of the EGR control valve is controlled in multiple steps in accordance with engine operating conditions, the amount of recirculated exhaust gases can be appropriately controlled. Thus, the engine can improve its performance related to exhaust gases. Especially, no EGR is conducted while the engine is not sufficiently warmed up or it is abruptly accelerated, thereby improving the exhaust gas purifying performance.

When the valve member changes its opened state to a closed state, the working medium is supplied to the third intake/exhaust port, and the second piston is moved in the closing direction of the valve member.

In this case, the second piston can be reliably moved in the closing direction of the valve member, thereby improving the exhaust gas purifying performance.

When the multiple step valve opening control system is applied to an EGR control valve unit including the third intake/exhaust port, the working medium supplied to the first intake/exhaust port and the second intake/exhaust port is a compressed fluid, and the first intake/exhaust port and the second intake/exhaust port are connected to a compressed fluid source via a first fluid control valve and a second fluid control valve, respectively.

In the foregoing system, the working medium supplied to the third intake/exhaust port is a compressed fluid, and the third intake/exhaust port communicates with the compressed fluid source via a third fluid control valve.

It is possible to use pressured oil or compressed air for a brake system of the vehicle as the working medium, which does not need any dedicated working medium source.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

FIGS. 1 to 10 show an EGR control valve unit to which embodiments of the invention are applied.

Figure 1:
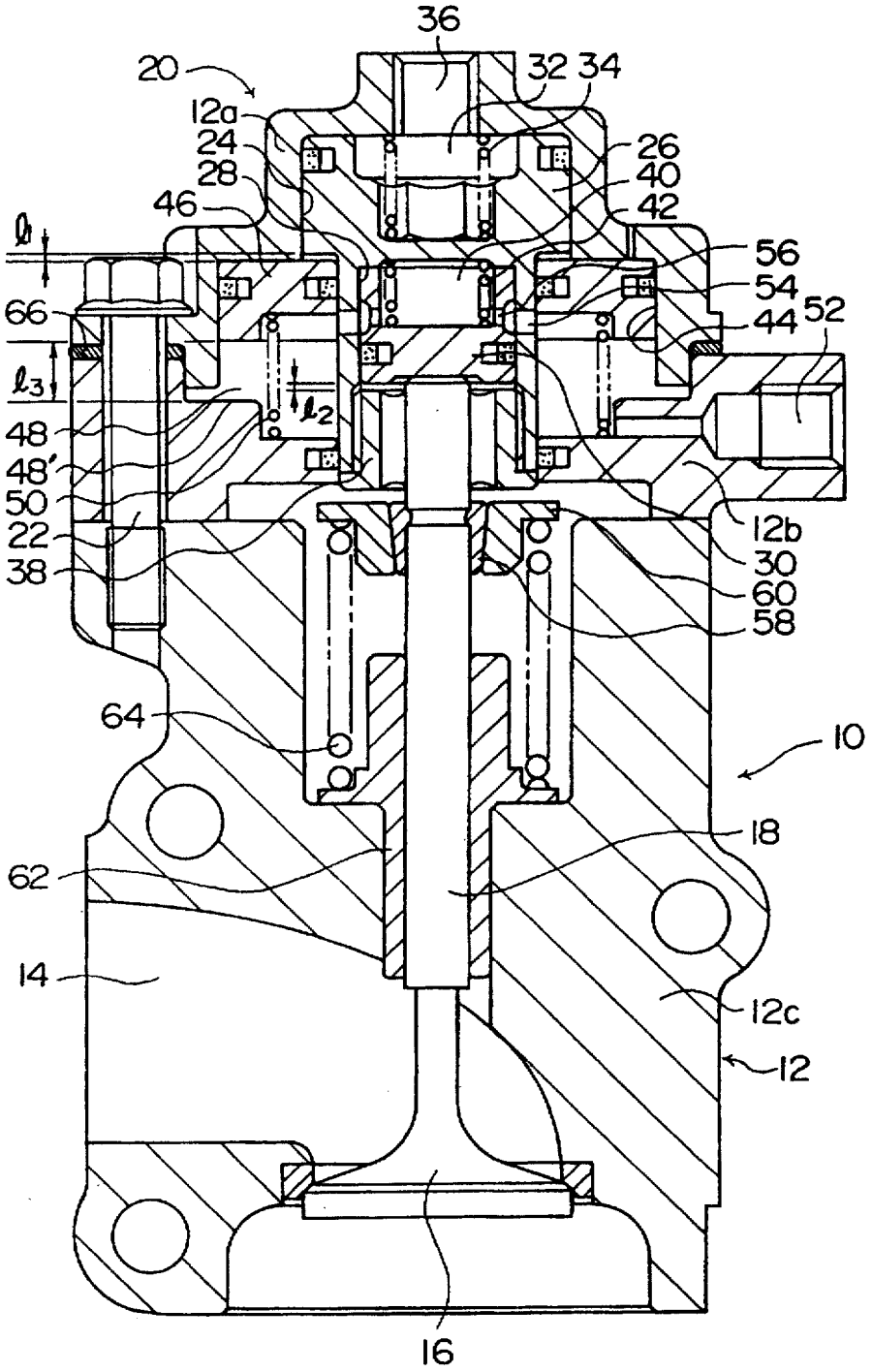
FIG. 1 is a cross section of an EGR control valve unit to which a first embodiment of the invention is applied.

A first embodiment of the invention is shown in FIGS. 1 to 8. Referring to FIG. 1, the EGR control valve unit 10 includes a housing 12 which is interposed in an EGR passage (not shown), and extracts and recirculates some of the exhaust gases to an inlet system of the engine.

The housing 12 encloses an exhaust gas passage 14, a valve member 16, and an actuator 20. The valve member 16 is a poppet valve which is disposed in the exhaust gas passage 14, and controls a flow amount of exhaust gases to be recirculated. The actuator 20 is operatively coupled to a valve stem 18 of the valve member 16 so as to control valve opening or lift.

The housing 12 is divided, on a plane which is substantially orthogonal to the valve stem 18, into an upper housing part 12*a*, an intermediate housing part 12*b*, and a lower housing part 12*c*. These three housing parts 12*a*, 12*b* and 12*c* are fastened by a plurality of bolts 22 so as to be integral with one another. The upper housing part 12*a* houses a first cylinder 24 which is substantially axial with the valve stem 18. The first cylinder 24 houses a axially slidable first piston 26 therein.

The first piston 26 includes a second cylinder 28 as an integral member extending toward the valve member 16. Alternatively, the second cylinder 28 may be separate from the first piston 26, and may be screwed into the first piston 26, be fitted thereinto under pressure, or be fixed therein by appropriate means.

The second cylinder 28 houses a second piston 30 which is axially slidable therein. In the first cylinder 24, a first working chamber 32 is defined by the first piston 26. The first working chamber 32 houses a first return spring 34, in a compressed state, which continuously resiliently urges the first piston 26 toward the valve member 16. A first intake/exhaust port 36 is formed in a top wall of the upper housing part 12*a*, and supplies a working medium such as compressed air to the first working chamber 32, and discharges the compressed air from the working chamber 32.

A stopper ring 38 is screwed into an end of the second cylinder 28, near the valve member 16. The stopper ring 38 determines a stroke $l_2$ of the second piston 30. The second piston 30 defines a second working chamber 40 in the second cylinder 28. The second working chamber 40 houses a second return spring 42 in a compressed state, which continuously resiliently urges the second piston 30 toward the valve member 16.

The upper housing part 12*a* also houses a third cylinder 44. The third cylinder 44 is coaxial with the first and the second cylinders 24 and 28, and has a third piston 46 fitted therein. The third piston 46 is tubular.

The third piston 46 is, via its outer surface, in slidable contact with an inner surface of the third cylinder 44, and is, via its inner surface, in slidable contact with an outer surface of the second cylinder 28.

In the third cylinder 44, a third working chamber 48 is defined by the upper and the intermediate housing parts 12*a* and 12*b*, at the bottom of the third piston 46, near the valve member 16. The third working chamber 48 houses a third return spring 50 in a compressed state. The third return spring 50 continuously urges the third piston 46 upwards such that it stays away from the valve member 16. As will be detailed later, the third piston 46, the third cylinder 44, the third return spring 50, the third working chamber 48 and so on constitute a first piston stroke regulating member for regulating a stroke of the first piston 26.

In a side wall of the intermediate housing part 12*b*, there is formed a second intake/exhaust port 52, which provides the compressed air into the third working chamber 48, and discharges the compressed air therefrom. The third working chamber 48 continuously communicates with the second working chamber 40 via a path 54 formed in the wall of the second cylinder 28 and a path 56 formed in the second piston 30, at all of the strokes of the second piston 30.

A spring retainer 60 is attached around the top of the valve stem 18 using a valve cotter 58. A valve spring 64 is disposed, in a compressed state, between the spring retainer 60 and a valve guide 62 into which the valve stem 18 is slidably fitted. The valve spring 64 urges the valve member 16 to the closed position shown in FIG. 1.

In the state shown in FIG. 1, no compressed air as the working medium is supplied to the first and second intake/exhaust ports 36 and 52, and the EGR control valve unit 10 remains inactive. Thus, the valve member 16 is completely closed by the valve spring 64 having a large spring constant. The second piston 30 is kept in pressure contact with the top of the valve stem 18 by the second return spring 42. The first piston 26 is kept in pressure contact with an annular head of the second piston 30 by the first return spring 34. The third piston 46 (i.e. the first piston stroke regulating member) is kept at a raised position by the third return spring 50.

In this state, there is axially a first predetermined clearance $l_1$ between the bottom of the first piston 26 and the top of the third piston 46. Further, there is axially a second predetermined clearance $l_2$ between the second piston 30 and the stopper ring 38. Still further, there is axially a third predetermined clearance $l_3$ between the bottom of the third piston 46 and the top of a stepped portion 48' of the third working chamber 48, near the bottom of the third cylinder 44. The third clearance $l_3$ is adjustable by changing a thickness of a shim 66 interposed between the upper housing part **12*a* and the intermediate housing part 12*b*. The second clearance $l_2$ is adjustable by changing a screwed position of the stopper ring 38**.

The following describes the operation of the actuator 20, assuming that the clearance $l_1$ is 1.5 mm, the clearance $l_2$ is 1 mm, and the clearance $l_3$ is 8.5 mm. (In order to simplify the description, the first to third return springs 34, 40 and 50 are not shown in FIG. 2 to FIG. 4.)

Figure 2:
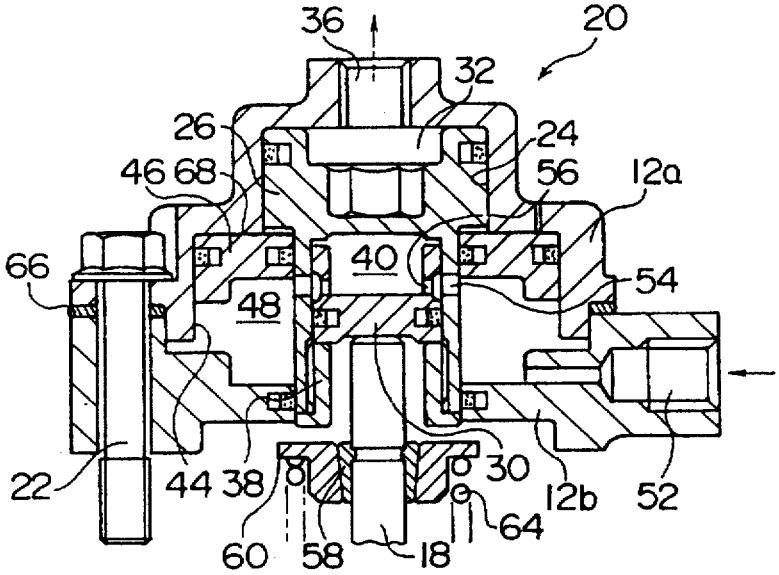
FIG. 2 is a cross section of the main part of the EGR control valve unit when a valve lift is minimum.

FIG. 2 shows a state in which the first intake/exhaust port 36 is open to the atmosphere, and the second intake/exhaust port 52 is receiving compressed air as the working medium. The compressed air is further introduced into the third working chamber 48 via the second intake/exhaust port 52, pushes the third piston 46 (i.e. the first piston stroke regulating member) upwards, and causes the third piston 46 to come into contact with a shoulder 68 formed between the first and third cylinders 24 and 44 in the upper housing part **12*a*. In this state, the first piston stroke regulating member 46** is held at a first position shown by a solid line in FIG. 2.

The compressed air is further introduced into the second working chamber 40 from the third working chamber 48 via the paths 54 and 56 via the paths 54 and 56, thereby pushing the second piston 30 downwards until it comes into contact with the stopper ring 38. The valve member 16 is opened by a first valve lift or opening $\Sigma_1$ (=1 mm, i.e. the clearance $l_2$) via the valve stem 18 which is in contact with the second piston 30. Therefore, exhaust gases, whose amount depends upon the first valve lift or opening $\Sigma_1$ and a difference of pressures upstream and downstream of the valve member 16, are recirculated to the intake system of the engine via the exhaust gas passage 14.

Figure 3:
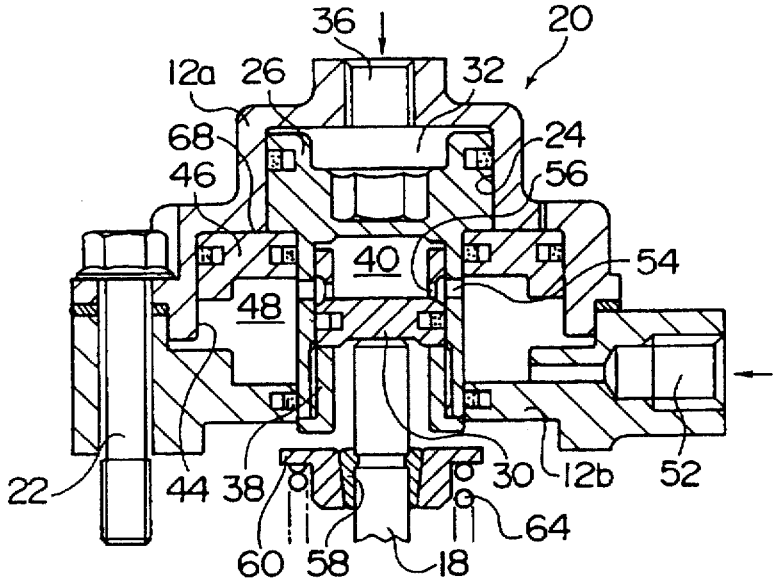
FIG. 3 is a view similar to FIG. 2, but showing that the valve lift is intermediate.

Referring to FIG. 3, the compressed air is introduced into both the first and second intake/exhaust ports 36 and 52. The compressed air further flows to the third working chamber 48 via the second intake/exhaust port 52, and pushes the third piston 46 upwards. The compressed air flowing to the first working chamber 32 via the first intake/exhaust port 36 pushes the first piston 26 downwards. However, when it comes into contact with the third piston 46, the first piston 26 is stopped. This is because the third piston 46 receives more compressed air in a large area than the first piston 26. In other words, the first piston 26 is displaced downwards by the clearance $l_1$ (=1.5 mm).

The compressed air introduced via the second intake/exhaust port 52 also pushes the second piston 30 downwards by the clearance $l_2$ (=1 mm) as described above with reference to FIG. 2. Thus, the valve member 16 is opened by a second valve lift or opening $\Sigma_2$ (=$l_1$+$l_2$=2.5 mm), so that exhaust gases are recirculated to the intake system of the engine via the exhaust gas passage 14. The amount of recirculated exhaust gases depends upon a difference of pressures upstream and downstream of the valve member 16 and the second valve lift or opening $\Sigma_2$.

Figure 4:
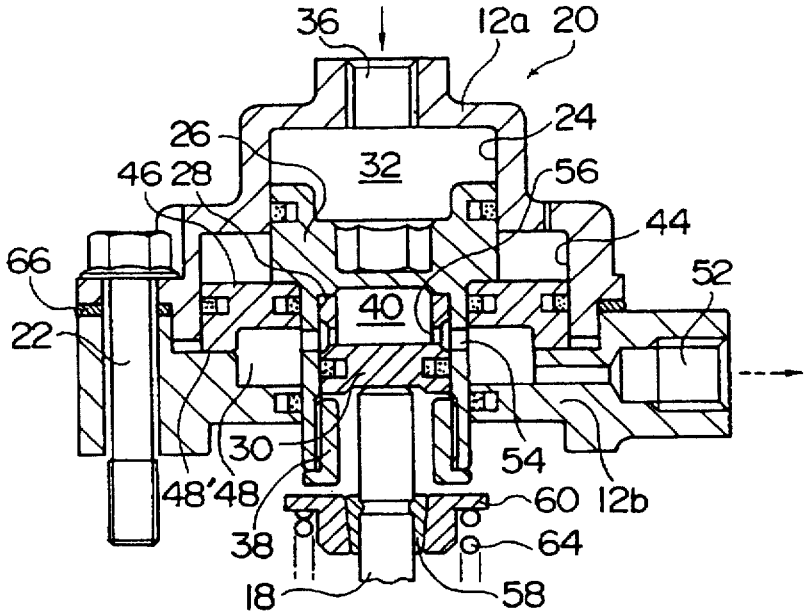
FIG. 4 is a view similar to FIG. 2, but showing that the valve lift is maximum.

FIG. 4 shows a state in which the first intake/exhaust port 36 receives the compressed air while the second intake/exhaust port 52 is open to the atmosphere. Since no compressed air acts on the third piston 46, the pressure of compressed air introduced into the first working chamber 32 pushes the first piston 26, which pushes the third piston 46 downwards. The first piston pushes the third piston 46 downwards by 10 mm ($l_1$+$l_3$) until the third piston 46 comes into contact with the stepped portion 48' near the bottom of the third cylinder 44. In this state, the third piston 46 (i.e. the first piston stroke regulating member) stays at a second position shown by a solid line in FIG. 4. The second working chamber 40 communicating with the third working chamber 48 is also open to the atmosphere. Thus, the second piston 30 is not pushed downwards since there is no compressed air in the second working chamber 40, but simply follows the first piston 26, as shown in FIG. 4. The valve member 16 is opened by the third valve lift or opening $\Sigma_3$ ($l_1$+$l_3$=10 mm) via the valve stem 18. Exhaust gases, whose amount depends upon a pressure difference upstream and downstream of the valve member 16 and the third valve lift or opening $\Sigma_3$, are recirculated to the intake system of the engine via the exhaust gas passage 14.

In the foregoing EGR control valve unit of FIG. 1, first of all, the compressed air is supplied to the second intake/exhaust port 52, and the first intake/exhaust port 36 is opened to the atmosphere. Then, the valve member 16 is opened by the first valve lift or opening $\Sigma_1$ (=$l_2$, e.g. 1 mm). Next, the compressed air is supplied to the first and second intake/exhaust ports 36 and 52. This causes the valve member 16 to be opened by the second valve lift $\Sigma_2$ (=$l_1$+$l_2$, e.g. 2.5 mm). Further, the compressed air is supplied to the first intake/exhaust port 36 while the second intake/exhaust port 52 is opened to the atmosphere. Thus, the valve member 16 is opened by the third lift or opening $\Sigma_3$ ($l_1$+$l_3$=10 mm).

According to the invention, the three lifts or openings $\Sigma_1$, $\Sigma_2$ and $\Sigma_3$ are available, i.e. the lift or opening $\Sigma_1$ is minimum, the lift or opening $\Sigma_2$ is close to the lift $\Sigma_1$, and the lift or opening $\Sigma_3$ is maximum. The valve member 16 can be opened as desired by setting the clearances (strokes) $l_1$, $l_2$ and $l_3$ to appropriate values. Especially, the stroke $l_3$ of the third piston 46, which functions as the first piston stroke regulating member, is set to an appropriate value, it is possible to obtain a sufficient difference between the minimum valve lift or opening $\Sigma_1$ and the maximum valve lift or opening $\Sigma_3$. Further, the stroke $l_1$ of the first piston 26 and the stroke $l_2$ of the second piston 30 are appropriately set, the minimum lift or opening $\Sigma l_1$ and the intermediate lift or opening $\Sigma_2$ can be determined with large tolerances.

Figure 5:
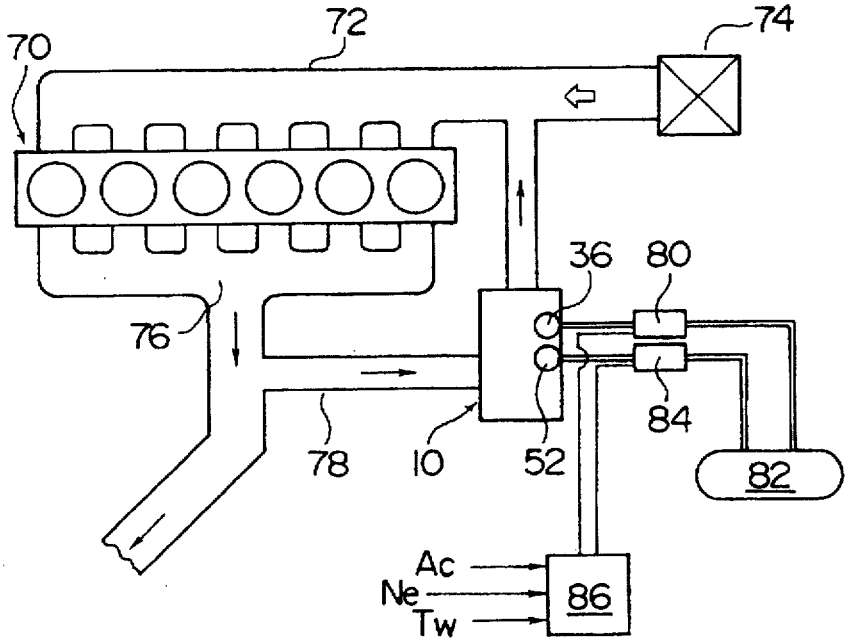
FIG. 5 is a schematic view showing the configuration of an engine including the EGR control valve unit of FIG. 1.

FIG. 5 schematically shows the configuration of a vehicle engine including the EGR control valve unit 10. In FIG. 5, reference numeral 70 is a 6-cylinder diesel engine for a truck or the like, 72 an intake pipe including an intake manifold, 74 an air cleaner disposed at an inlet port of the intake pipe 72, 76 an exhaust pipe including an exhaust manifold, and 78 an EGR passage for recirculating extracted exhaust gases to the intake pipe 72 from the exhaust pipe 76. The EGR control valve unit 10 is interposed in the EGR passage 78.

The first intake/exhaust port 36 of the EGR control valve unit 10 is connected to the compressed air source 82 as a compressed fluid source via a first three-way solenoid valve 80 as a first fluid control valve while the second intake/exhaust port 52 is connected to the compressed air source 82 via a second three-way solenoid valve 84 as a second fluid control valve. Compressed air is used as the compressed fluid.

The first and second three-way solenoid valves 80 and 84 are controlled by a control unit 86 which receives a signal Ac indicative of an accelerator opening amount, a signal Ne indicative of an engine speed, and a signal Tw indicative of a cooling water temperature of the engine 70, and generates a drive signal.

Figure 6:
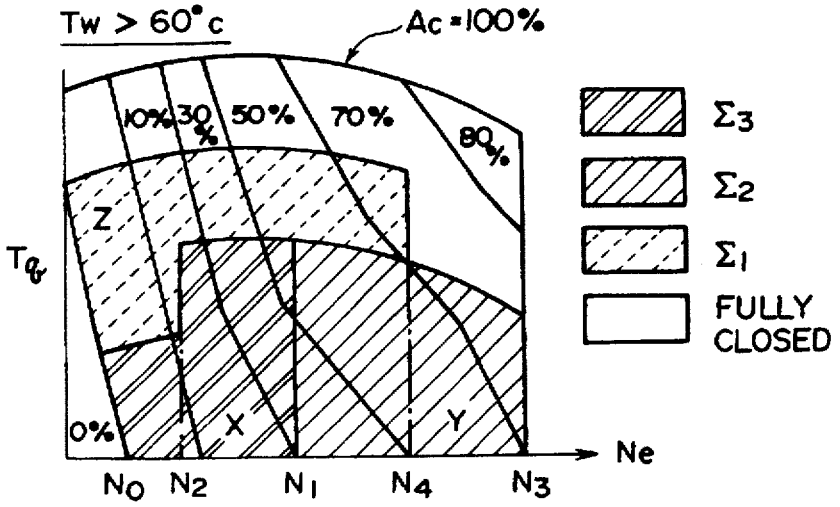
FIG. 6 is an example of a control map stored in a control unit in the engine shown in FIG. 5.

The control unit 86 stores a control map as shown in FIG. 6. The control map shows valve lifts or openings of the valve member 16 under various engine operating conditions when the cooling water is 60° C. or more, i.e. after the engine 70 is warmed up. Patterns at the right side of FIG. 6 denote valve lifts or openings of the valve member 16. The ordinate represents torque Tq, and the abscissa represents the engine speeds Ne. The oblique lines accompanying values in percentage represent degrees of accelerator opening AC.

Referring to FIG. 6, a first operating state X is defined by an engine speed which is lower than a predetermined speed $N_1$, and by a load which is a first predetermined load or less. The foregoing load is represented by a border line which is indented close to a speed $N_2$ which is lower than the predetermined speed $N_1$.

When the engine 70 is operated in the state X, the control unit 86 activates the first three-way solenoid valve 80 such that the compressed air source 82 supplies the compressed air only to the first intake/exhaust port 36. The valve member 16 is opened by the third valve lift or opening $\Sigma_3$, so that exhaust gases are recirculated from the exhaust pipe 76 to the intake pipe 72 via the EGR passage 78 and the maximally opened valve member 16. In the first operating state X, a relatively small amount of the exhaust gases having a low pressure flow through the exhaust pipe 76, and negative pressure in the intake pipe 72 is small. It is generally difficult to recirculate exhaust gases to the intake pipe 72 from the exhaust pipe 76. Thus, the valve member 16 is opened by the third valve lift or opening $\Sigma_3$, i.e. it is fully opened, so that a necessary amount of exhaust gases can be recirculated to the intake pipe 72. This enables effective reduction of $NO_x$ and assures good engine performances such as high engine output and fuel consumption.

A second operating state Y shown in FIG. 6 is defined by the engine speed which is above the predetermined speed $N_1$ and by the load which is a second predetermined load or less. A border line representing the second predetermined load or less is moderately curved, and joins with the border line denoting the first predetermined load or less, at a point denoting the predetermined speed $N_1$.

When the engine 70 is operated in the state Y, the control unit 86 activates the first and second three-way solenoid valves 80 and 84, so that the first and second intake/exhaust ports 36 and 52 receive the compressed air from the compressed air source 82. Thus, the valve member 16 is opened by the second valve lift or opening $\Sigma_2$ which is close to the minimum valve lift or opening. In the operating state Y, the engine speed Ne is sufficiently high, the negative pressure in the intake pipe 72 is high, and exhaust gases in the exhaust pipe 76 have a relatively high pressure. Therefore, the valve member 16 is opened by the second valve lift or opening $\Sigma_2$, so that an appropriate amount of the exhaust gases are recirculated to the intake system of the engine 70 via the valve member 16.

FIG. 6 further shows that a third operating state Z is defined by a combination of the engine speed which is the predetermined speed $N_1$ or less and the load which is above the first predetermined load, and by a combination of the engine speed which is predetermined high speed $N_4$ or less, and by the load which is above the second predetermined load. The predetermined high speed $N_4$ is higher than the predetermined speed $N_1$. The border line denoting the first predetermined load or less is indented close to a speed $N_2$ which is lower than the predetermined speed $N_1$, as described with respect to the operating state X. In other words, the operating state Z is defined by the load which is larger than the first and second predetermined loads and smaller than a full load.

When the engine 70 is operated in the state Z, the control unit 86 activates the second three-way solenoid valve 84, so that only the second intake/exhaust port 52 receives the compressed air from the compressed air source 82. Thus, the valve member 16 is opened by the minimum valve lift or opening $\Sigma_1$ as described above. In the operating state Z, exhaust gases in the exhaust pipe 76 have a relatively high pressure at an engine speed above the intermediate speed, and the negative pressure in the intake pipe 72 is relatively high. As a result, a sufficient amount of exhaust gases can be recirculated even when the valve member 16 is opened by the minimum valve lift or opening $\Sigma_1$. Further, when the engine is operated at a low speed in the operating state Z, a relatively small amount of air is introduced into the intake system but a relatively large amount of fuel is supplied. Thus, if exhaust gases are excessively recirculated, a lot of smoke would be generated. In order to prevent this, the valve member 16 should be opened by the minimum valve lift or opening $\Sigma_1$.

When the engine is operating in states other than the states X, Y and z, i.e. in states shown by non-shaded areas in FIG. 6, recirculation of exhaust gases is not necessary in view of the engine performance factors such as output and fuel consumption, and necessity of reducing $NO_x$ in exhaust gases. Thus, the control unit 86 deactivates the first and second three-way solenoid valves 80 and 84, and the first and second intake/exhaust ports 36 and 52 are opened to the atmosphere, thereby leaving the valve member 16 fully closed as shown in FIG. 1.

Figure 8:
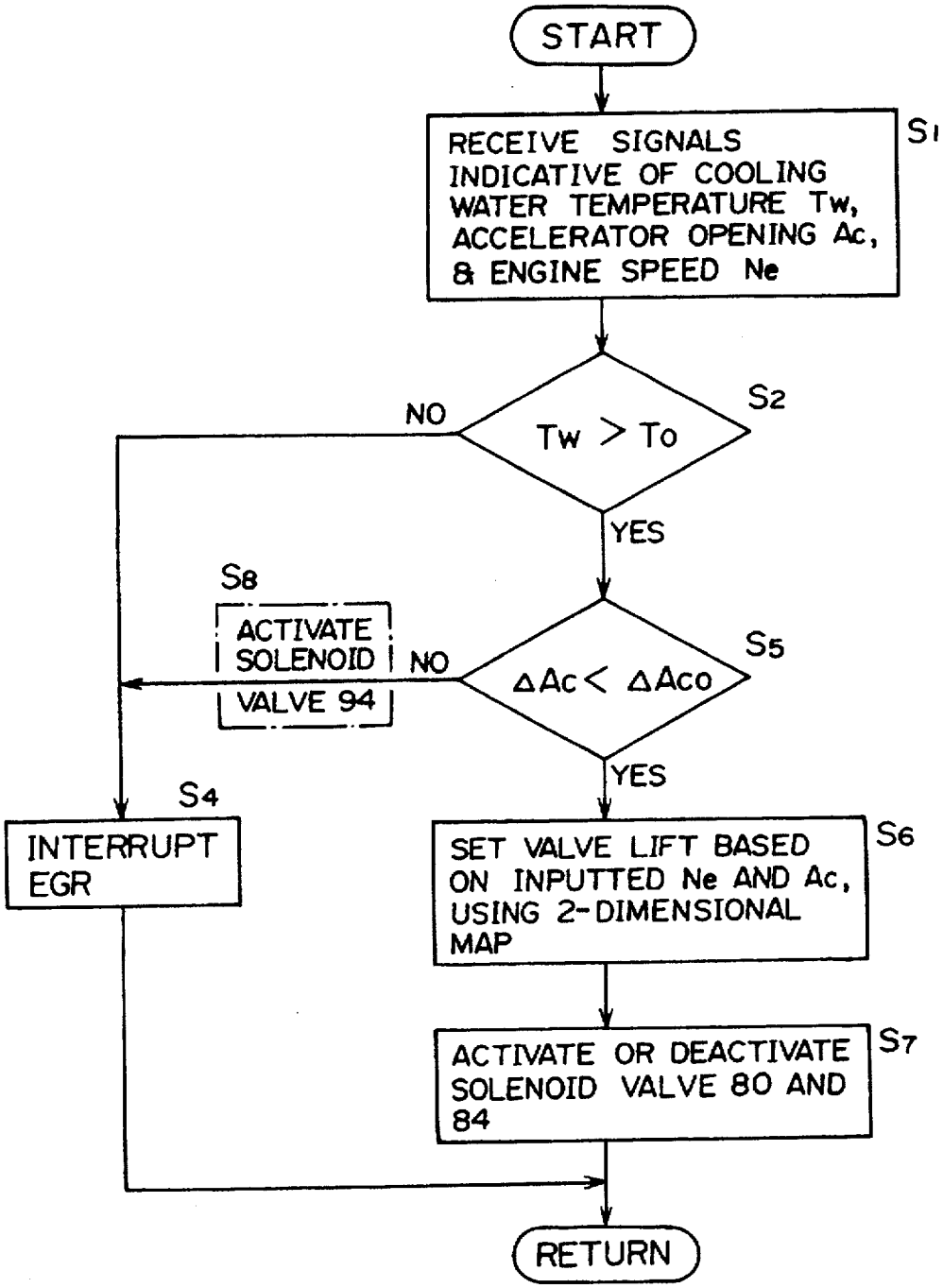
FIG. 8 is a flow chart showing the operation sequence of the control unit in the engine FIG. 5 and a control unit in an engine shown in FIG. 10.

The control unit 86 operates in the sequence shown in FIG. 8. After the control program is started, the control unit 86 receives, in step $S_1$, operational data about the engine 70, i.e. a cooling water temperature Tw, accelerator opening amount Ac, and an engine speed Ne. In step $S_2$, it is checked whether or not the cooling water temperature Tw is higher than a predetermined value To (e.g. 60° C.). If Tw is below To (i.e. NO), the engine 70 is recognized as not having completed warm-up. Thus, the exhaust gas recirculation (EGR) is not preferable in this state, and no exhaust gases will be recirculated (step $S_4$) (since the engine 70 has difficulty with cold starting, or smoke will be increased in the exhaust gases).

When the engine 70 is recognized as having been warmed up in step $S_2$ (i.e. YES), it is checked in step $S_5$ whether or not an increase ΔAc of the accelerator opening Ac is smaller than a predetermined value ΔAco. If the increase ΔAc is smaller than ΔAco (i.e. the vehicle is running steadily without abrupt acceleration), the control program is advanced to step $S_6$. In step $S_6$, the valve member 16 is set to be opened by the valve lift or opening $\Sigma_1$, $\Sigma_2$, or $\Sigma_3$, or is completely closed, based on the two-dimensional control map shown in FIG. 6. In step $S_7$, a command is issued to activate or deactivate the solenoid valves 80 and 84. Thus, the valve lift of the valve member 16 is controlled as described above.

When ΔAc is recognized as being larger than ΔAco (i.e. NO) in step $S_5$ (i.e. the vehicle is abruptly accelerating), smoke tends to increase and become dense in the exhaust gases. In this state, no exhaust gases will be recirculated, thereby reducing smoke. In step $S_5$, the variation of the accelerator opening Ac is checked. Alternatively, a difference, either increase and decrease, of a current accelerator opening from a previous accelerator opening at a predetermined preceding time may be checked, and compared with a predetermined difference of the accelerator opening (on the increasing side).

Figure 9:
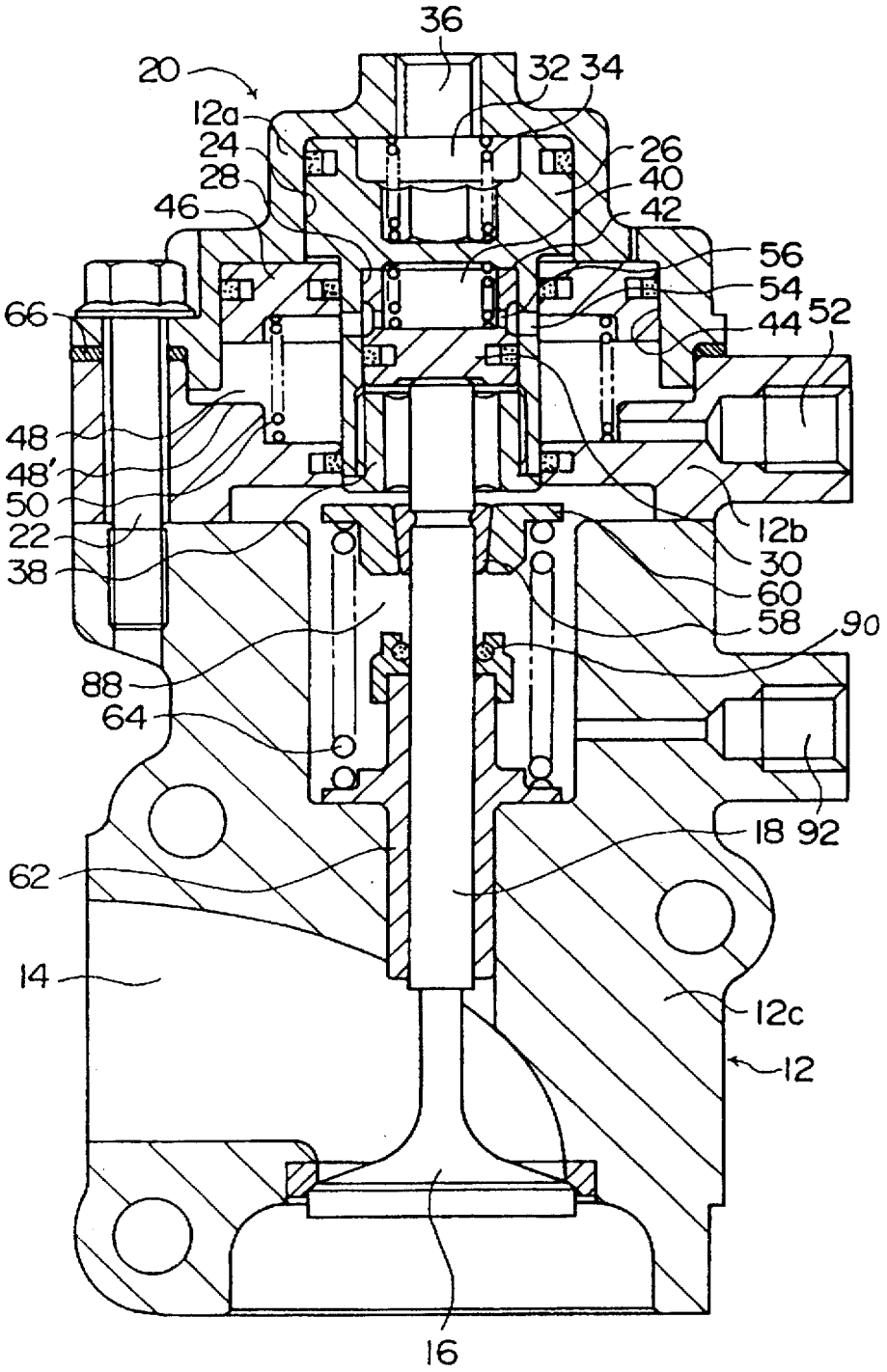
FIG. 9 is a cross section of an EGR control valve unit to which a second embodiment of the invention is applied.
Figure 10:
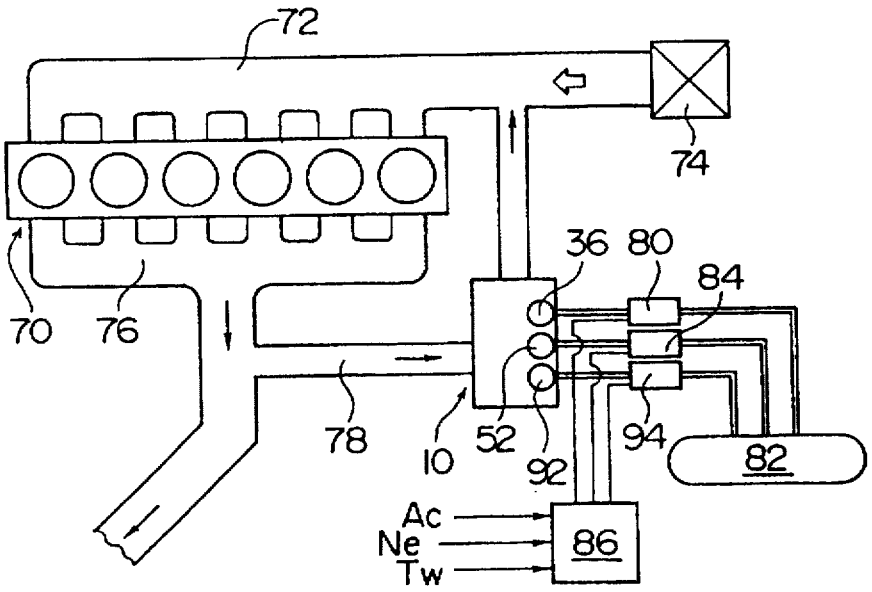
FIG. 10 is a schematic view showing the configuration of an engine including the EGR valve unit of FIG. 9.
Figure 11:
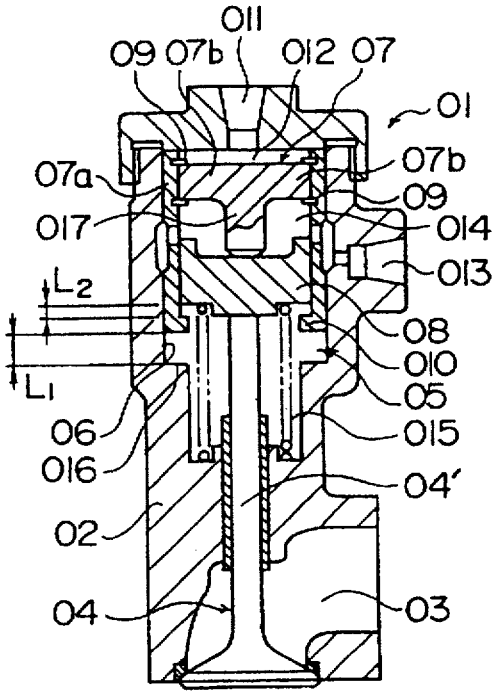
FIG. 11 PRIOR ART
FIG. 11 is a cross section of an example of EGR control valve units of the prior art.

In a second embodiment of the invention, an EGR control valve unit is configured as shown in FIG. 9. In the second embodiment, a fourth working chamber 88 is defined by the intermediate and the lower housing parts **12*b* and 12*c* so as to enclose the upper part of the valve stem 18. An ordinary valve guide seal 90 is attached around the top of the valve guide 62 so as to seal the fourth working chamber 88. Further, a third intake/exhaust port 92 is formed in the side wall of the lower housing part 12*c*, and communicates with the fourth working chamber 88. Referring to FIG. 10, the third intake/exhaust port 92 is connected to the working medium source, i.e. the compressed air source 82 in this embodiment, via a third three-way solenoid valve 94**.

As can be seen from FIGS. 9 and 10, the second embodiment is substantially identical to the first embodiment except for the fourth working chamber 88 and the third intake/exhaust port 92.

The second embodiment is also controlled in accordance with the flow chart shown in FIG. 8. It is assumed that the vehicle is abruptly accelerated while the valve member 16 in the EGR valve control unit 10 is opened by the valve lift or opening $\Sigma_1$, $\Sigma_2$ or $\Sigma_3$. In this case, ΔAc is recognized as being larger than ΔAco in step $S_5$ (i.e. NO), the third three-way solenoid valve 94 is activated in response to the drive signal from the control unit 86, as shown by a phantom line in FIG. 8. Then, the compressed air is introduced into the fourth working chamber 88 from the compressed air source 82. As a result, the EGR is interrupted in step $S_4$, i.e. the first and second three-way solenoid valves 80 and 84 are deactivated. In order to completely close the valve member 16 by the valve spring 64 as shown in FIG. 9, the second piston 30 is progressively urged upwards by the compressed air in the fourth working chamber 88.

Figure 7:
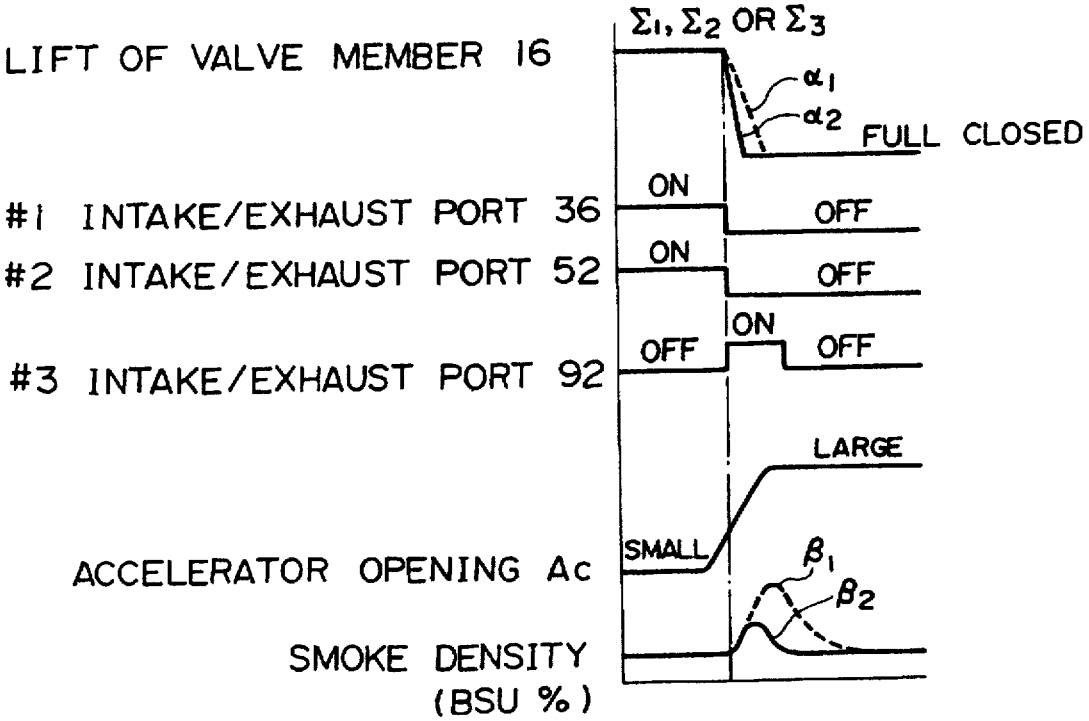
FIG. 7 is a timing chart showing operation states of the EGR control valve unit of FIG. 1 and an EGR control valve unit shown in FIG. 9.

In the first embodiment, if the vehicle is abruptly accelerated while the valve member 16 is opened by the valve lift or opening $\Sigma_1$, $\Sigma_2$ or $\Sigma_3$, the valve member 16 will be completely closed with a relatively long time delay (i.e. the EGR is interrupted), as shown by a dashed line $\alpha_1$ in FIG. 7. In this case, the density of smoke is temporarily and extensively increased as shown by another dashed line $\beta_1$ in FIG. 7.

However, in the second embodiment, the valve member 16 is fully closed in a short length of time as shown by a solid line $\alpha_2$. Further, the density of smoke is extensively reduced as shown by another solid line $\beta_2$. The third three-way solenoid valve 94 is preferably kept active for a length of time necessary for the complete closure of the valve member 16 or slightly longer than this length of time.

In the first and second embodiments, the poppet valve is used as the valve member 16. Alternatively, the valve member 16 may be a butterfly valve which is extensively utilized for an exhaust brake in a truck or the like. In such a case, a drive link or an arm is made to project from the valve stem 18. The butterfly valve as the valve member 16 may have its opening or an angle controlled by either the drive link or arm which is turned via a piston rod fixed to the second piston 30 or a link coupled to the second piston 30.

The multiple step valve opening control system can set the valve lifts or openings in a wide range, so that it is advantageously applicable to an EGR control valve unit for an engine of a motor vehicle in which an amount of exhaust gases to be recirculated varies extensively. Especially, when it is applied to a diesel engine in a truck or the like, the multiple step valve opening control system is effective in reducing $NO_x$ in exhaust gases while maintaining engine performance factors such as high output and fuel consumption.

The invention being thus described, it will be obvious that the same may be varied in many ways. For example, it may be applicable to a variety of valve units which require three types of valve lifts. In the foregoing embodiments, other kinds of pressured fluid, for instance, pressured oil for a braking system of a vehicle, can be used as the working medium in place of the compressed air.

What is claimed is:

1. A multiple step valve opening control system comprising:

(a) a valve member interposed in a fluid passage, the valve member being opened by a plurality of steps for controlling a flow amount of a fluid;

(b) a first piston slidably fitted in a first cylinder disposed in a housing;

(c) a second cylinder substantially coaxially coupled to or being integral with the first piston;

(d) a second piston slidably fitted in the second cylinder and operatively coupled to the valve member;

(e) a resilient member coupled to the valve member, the resilient member continuously urging the valve member in a closing direction;

(f) a first intake/exhaust port formed in the housing, the first intake/exhaust port supplying a working medium to a first working chamber defined in the first cylinder (24), and displacing the second piston via the first piston in a direction for opening the valve member;

(g) a second intake/exhaust port formed in the housing, the second intake/exhaust port supplying the working medium to a second working chamber defined in the second cylinder, and displacing the second piston by a second predetermined extent ($l_2$) in the direction for opening the valve member; and (h) a first piston stroke regulating member housed in the housing, the first piston stroke regulating member being held at a first position for regulating, to a first predetermined extent ($l_1$), an allowable displacement of the first piston in the opening direction of the valve member when the working medium is supplied to the second working chamber from the second intake/exhaust port and to the first working chamber from the first intake/exhaust port and to the first working chamber from the first intake/exhaust port, and the first piston stroke regulating member being held at a second position for regulating the allowable displacement of the first piston in the opening direction of the valve member to the first predetermined extent ($l_1$) with the addition of a third predetermined extent ($l_3$), when no working medium is supplied to the second working chamber from the second intake/exhaust port but the working medium is supplied to the first working chamber from the first intake/exhaust port.

2. The multiple step valve opening control system according to claim 1, wherein the first piston stroke regulating member includes a third piston which is fitted in a third cylinder in the housing, and is slidable between the first position and the second position, on an outer surface of the second cylinder.

3. The multiple step valve opening control system according to claim 1, wherein the second intake/exhaust port communicates with a third working chamber in the third cylinder, and the second working chamber.

4. The multiple step valve opening control system according to claim 3, wherein when the working medium is supplied to the third working chamber, the third piston is held at the first position, and when the working medium is supplied to the third working chamber and the first working chamber, the first piston slides in the first cylinder in the opening direction of the valve member, and comes into contact with and is stopped by the third piston held at the first position, so that the displacement of the first piston is regulated to the first predetermined extent ($l_1$).

5. The multiple step valve opening control system according to claim 4, wherein when no working medium is supplied to the third working chamber, the third piston is movable to the second position which is beyond the first position in the opening direction of the valve member, and when no working medium is supplied to the third working chamber but the working medium is supplied to the first working chamber, the first piston slides in the first cylinder to the second position in the opening direction of the valve member, and comes into contact with and is held by the third piston, so that the displacement of the first piston in the opening direction of the valve member is regulated to the sum of the first predetermined extent ($l_1$) and the third predetermined extent ($l_3$).

6. The multiple step valve opening control system according to claim 5, further comprising a third piston urging member for urging the third piston in a closing direction of the valve member, wherein when no working medium is supplied to the third working chamber but the working medium is supplied to the first working chamber, the first piston slides in the first cylinder in the opening direction of the valve member, comes into contact with the third piston at the first position, slides with the third piston to the second position against an urging force of the third piston urging member, and is held at the second position, so that the displacement of the first piston in the opening direction of the valve member is regulated to the sum of the first and the third predetermined extents ($l_1$) and ($l_3$).

7. The multiple step valve lift control system according to claim 1, further comprising a stopper which is positioned near an end of the second cylinder in the opening direction of the valve member, is axially screwed into the second cylinder, and regulates the displacement of the second piston when the second piston slides in the second cylinder in the opening direction of the valve member and comes into contact with the stopper, wherein the displacement of the second piston is adjustable by changing the position where the stopper is screwed into the second cylinder.

8. The multiple step valve opening control system according to claim 1, wherein the fluid passage is an EGR (exhaust gas recirculation) passage for recirculating some of the exhaust gases to an intake system of an engine, and the valve member is an EGR control valve for controlling the flow amount of exhaust gases recirculated to the intake system.

9. The multiple step valve opening control system according to claim 1, wherein:

when the engine is operated in a first operating state where an engine speed is a predetermined speed or less and under a first predetermined load or less, the working medium is supplied to the first intake/exhaust port and the first piston is displaced by the third predetermined extent in the opening direction of the valve member;

when the engine is operated in a second operating state where the engine speed is above the predetermined speed and under a second predetermined load or less, the working medium is supplied to both the first intake/exhaust port and the second intake/exhaust port, the first piston is displaced by the first predetermined extent ($l_1$) in the opening direction of the valve member, and the second piston is displaced by the second predetermined extent ($l_2$) in the opening direction of the valve member; and when the engine is operated in a third operating state which consists of an operating state where the engine speed is the predetermined speed or less and under a load above the first predetermined load, and an operating state where the engine speed is above the predetermined speed and a predetermined high speed or less which is higher than the predetermined speed and under a load above the second predetermined load, the working medium is supplied to the second intake/exhaust port, and the second piston is displaced by the second predetermined extent ($l_2$) in the opening direction of the valve member.

10. The multiple step valve opening control system according to claim 9, wherein the valve member is made to remain closed by the resilient member, when the engine is operated in operating states other than the first to the third operating states, when the engine is abruptly accelerated, and when a temperature of engine cooling water is a predetermined value or less.

11. The multiple step valve opening control system according to claim 1, wherein the working medium supplied to the fist intake/exhaust port and the second intake/exhaust port is a compressed fluid, and the first intake/exhaust port and the second intake/exhaust port are connected to a compressed fluid source via a first fluid control valve and a second fluid control valve, respectively.

12. The multiple step valve opening control system according to claim 1, further comprising a fourth working chamber formed in the housing at a first pressure receiving face opposite to a second pressure receiving face of the second piston which confronts with the second working chamber, and a third intake/exhaust port for supplying the working medium to the fourth working chamber.

13. The multiple step valve opening control system according to claim 12, wherein the fluid passage is an EGR (exhaust gas recirculation) passage for recirculating some of the exhaust gases to an intake system of the engine, and the valve member is an EGR control valve for controlling a flow amount of exhaust gases recirculated to the intake system.

14. The multiple step valve opening control system according to claim 13, wherein:

when the engine is operated in a first operating state where an engine speed is a predetermined speed or less and under a first predetermined load or less, the working medium is supplied to the first intake/exhaust port and the first piston is displaced by the third predetermined extent in the opening direction of the valve member;

when the engine is operated in a second operating state where the engine speed is above the predetermined speed and under a second predetermined load or less, the working medium is supplied to both the first intake/exhaust port and the second intake/exhaust port, the first piston is displaced by the first predetermined extent ($l_1$) in the opening direction of the valve member, and the second piston is displaced by the second predetermined extent ($l_2$) in the opening direction of the valve member; and when the engine is operated in a third operating state which consists of an operating state where the engine speed is the predetermined speed or less and under a load above the first predetermined load, and an operating state where the engine speed is above the predetermined speed and a predetermined high speed or less which is higher than the predetermined speed and under a load above the second predetermined load, the working medium is supplied to the second intake/exhaust port, and the second piston is displaced by the second predetermined extent ($l_2$) in the opening direction of the valve member.

15. The multiple step valve opening control system according to claim 14, wherein the valve member is made to remain closed by the resilient member when the engine is operated in operating states other than the first to the third operating states, when the engine is abruptly accelerated, and when a temperature of engine cooling water is a predetermined value or less.

16. The multiple step valve opening control system according to claim 15, wherein when the valve member changes its opened state to a closed state, the working medium is supplied to the third intake/exhaust port, and the second piston is moved in the closing direction of the valve member.

17. The multiple step valve opening control system, according to claim 12, wherein the working medium supplied to the first intake/exhaust port and the second intake/exhaust port is a compressed fluid, and the first intake/exhaust port and the second intake/exhaust port are connected to a compressed fluid source via a first fluid control valve and a second fluid control valve, respectively.

18. The multiple step valve opening control system according to claim 17, wherein the working medium supplied to the third intake/exhaust port is a compressed fluid, and the third intake/exhaust port communicates with the compressed fluid source via a third fluid control valve.

* * * * *